United States Patent [19]

Hirosawa

[11] 4,205,024

[45] May 27, 1980

[54] CARBURETOR

[75] Inventor: Tamio Hirosawa, Odawara, Japan

[73] Assignee: Mikuni Kogyo Kabushiki Kaisha, Tokyo, Japan

[21] Appl. No.: 963,944

[22] Filed: Nov. 27, 1978

[51] Int. Cl.[2] ..... F02M 19/06

[52] U.S. Cl. ..... 261/34 R; 261/41 D; 261/121 A; 261/DIG. 39

[58] Field of Search ..... 261/DIG. 39, 34 R, 41 D, 261/72 R, 121 A

[56] References Cited

U.S. PATENT DOCUMENTS

| | | | |
|---|---|---|---|
| 1,240,841 | 9/1917 | Gilles | 261/41 D |
| 1,254,659 | 1/1918 | Coulombe | 261/41 D |
| 1,752,551 | 4/1930 | Ensign et al. | 261/41 D |
| 1,849,720 | 3/1932 | Parkin, Sr. | 261/41 D |
| 1,865,851 | 7/1932 | Geiger | 261/41 D |
| 1,976,452 | 10/1934 | Mock | 261/41 D |
| 2,186,480 | 1/1940 | Ensign | 261/41 D |
| 2,225,194 | 12/1940 | Melcher | 261/41 D |
| 3,093,699 | 6/1963 | Demitz | 261/41 D |
| 3,100,236 | 8/1963 | Ott et al. | 261/41 D |
| 3,103,544 | 9/1963 | Kalert, Jr. et al. | 261/41 D |
| 3,168,599 | 2/1965 | Marsee et al. | 261/DIG. 39 |
| 3,265,050 | 8/1966 | Tuckey | 261/41 D |
| 3,288,446 | 11/1966 | Bimberg | 261/41 D |
| 3,834,679 | 9/1974 | Baribeau et al. | 261/DIG. 39 |
| 4,003,968 | 1/1977 | Rickert | 261/DIG. 57 |

FOREIGN PATENT DOCUMENTS

| | | | |
|---|---|---|---|
| 386077 | 12/1923 | Fed. Rep. of Germany | 261/DIG. 39 |

*Primary Examiner*—Tim R. Miles

*Attorney, Agent, or Firm*—Cushman, Darby & Cushman

[57] ABSTRACT

A carburetor provided with a butterfly-shaped throttle valve wherein, in order to make it easy to attach and remove a main nozzle, main jet, pilot jet, pilot air jet and others to and from a carburetor body, the main nozzle assembly including the main nozzle and main jet, the pilot jet, pilot air jet and others are made to be able to be attached from above or outside the carburetor body and a cover plate is provided to hold the main nozzle assembly and others in predetermined positions.

7 Claims, 6 Drawing Figures

CARBURETOR

BACKGROUND OF THE INVENTION (a) Field of the Invention

This invention relates to carburetors for internal combustion engines and more particularly to improvements in a carburetor of a type provided with a butterfly-shaped throttle valve.

(b) Description of the Prior Art

FIG. 1 shows a basic structure of a carburetor of a type provided with a known butterfly-shaped throttle valve used mostly for internal combustion engines for general purposes. In the drawing, reference numeral 1 indicates a carburetor body, 2 indicates a venturi portion, 3 indicates a butterfly-shaped throttle valve, 4 indicates a main nozzle, 5 indicates a main jet, 6 indicates a main air jet, 7 indicates a pilot jet, 8 indicates a pilot air jet, 9 indicates a low speed fuel passage, 10 indicates an idling screw, 11 indicates a float, 12 indicates a cover case for defining a float chamber, 13 indicates a screw for attaching the cover case 12 to the carburetor body 1 and 1A indicates a boss portion hanging into the float chamber. As this kind of carburetor is arranged as described above, for example, in case the main jet 5 is to be removed from the boss portion 1A so as to be replaced, first the cover case 12 will have to be removed from the carburetor body 1. As a result, when the carburetor is attached to an engine, a very difficult work will be forced. Further, as the boss portion 1A occupies a comparatively large volume part within the float chamber, the effective volume of the float chamber will reduce and therefore the float chamber will have to be comparatively large as a whole. As the float 11 must also be made to be in such form as will not contact the boss portion 1A, there has been a disadvantage that the structure is limited. The same problem as in the case of the main jet 5 will occur also in the case of replacing the pilot jet 7.

SUMMARY OF THE INVENTION

A primary object of the present invention is to eliminate the above described defects in a carburetor of the above mentioned type.

According to the present invention, this object is attained by suspending a main nozzle assembly including a main jet and main air jet into a float chamber across a venturi portion from the upper portion of a carburetor body and setting a pilot jet in the upper portion of the carburetor body.

Another object of the present invention is to provide a carburetor wherein such parts as a main nozzle, main jet and pilot jet are so arranged as to be able to be easily attached to and removed from a carburetor body.

A further object of the present invention is to provide a small carburetor of a simplified structure.

Another object of the present invention is to provide a carburetor which can be manufactured at a low cost.

These and other objects of the present invention will become more apparent during the course of the following detailed description and appended claims.

DESCRIPTION OF THE PREFERRED EMBODIMENTS

Figure 1:
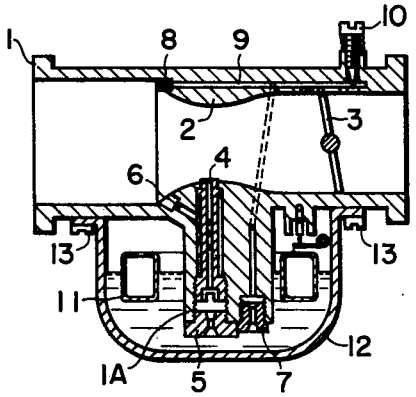
FIG. 1 PRIOR ART
FIG. 1 is a vertical sectional view showing a basic structure of a conventional carburetor provided with a butterfly-shaped throttle value.

In the embodiments of the present invention described in the following, the same corresponding reference numerals are attached to the same parts and portions as in FIG. 1.

Figure 2:
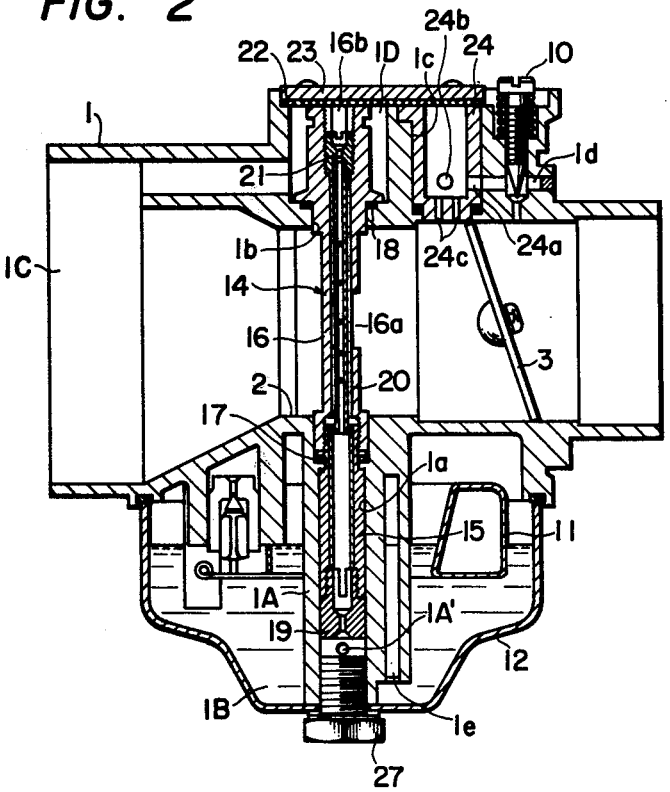
FIG. 2 is a vertical sectional view showing a carburetor embodying the present invention.
Figure 4:
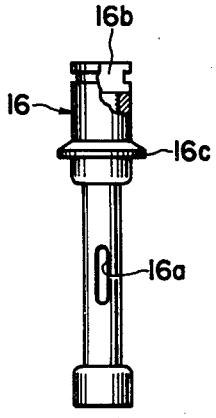
FIG. 4 is an elevational view of a nozzle tube.
Figure 5:
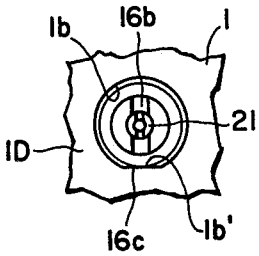
FIG. 5 is a top view of a main nozzle assembly.

First, with reference to FIG. 2, reference numeral 14 indicates a main nozzle assembly including a tubular jet holder 15 air-tightly fitted within a through hole **1*a* extending vertically to a boss portion 1A and a nozzle tube 16 inserted air-tightly through a hole 1*b* made in the upper portion of a carburetor body 1 coaxially with the through hole 1*a* and screwed at the lower end to the upper end of the jet holder 15 within the through hole 1*a*. The air-tightness between the through hole 1*a* and jet holder 15 is secured by an O-ring 17 interposed between a step portion formed within the through hole 1*a* and a flange portion formed in the jet holder 15. The air-tightness between the hole 1*b* and nozzle tube 16 secured by an O-ring 18 interposed between a step portion formed in the hole 1*b* and a flange portion formed in the nozzle tube 16. A main jet 19 is screwed to the lower end of the jet holder 15. The inlet of the main jet 19 communicates with the interior of a float chamber 1B through a hole 1A' made in the side wall of the boss portion 1A. A bleeding pipe 20 is inserted into the nozzle tube 16, extends in the lower end portion to the upper end portion of the jet holder 15 and is connected at the upper end to a main air jet 21 screwed in from the upper open end of the nozzle tube 16. A vertically extended slot-shaped nozzle 16*a* (FIG. 4) is formed in the middle portion exposed within a suction bore 1C of the nozzle tube 16 and is directed toward the downstream side of the suction bore 1C, that is, toward the throttle valve 3. Alternatively, a plurality of nozzles may be provided. The head portion of the nozzle tube 16 is positioned within the large diameter portion of the hole 1*b* and an annular air chamber 1D communicating with the suction bore 1C is formed between the outer peripheral surface of this head portion and the inner wall surface of the large diameter portion of the hole 1*b*. A diametrally extending groove 16*b* (FIG. 5) is formed on the top surface of the nozzle tube 16. The inlet of the main air jet 21 communicates with the air chamber 1D through the groove 16*b*. Further, a flat cut portion 16*c* (FIG. 5) is provided in the flange portion of the nozzle tube 16. Only when this cut portion 16*c* meets a corresponding flat cut portion 1*b'* (FIG. 5) formed on the inner wall of the hole 1*b*, will the main nozzle assembly 14 will be able to occupy a correct position (in which the nozzle 16*a* is directed toward the throttle valve 3) shown in FIG. 2. The nozzle 16*a* is directed toward the throttle valve 3, that is, toward the intake manifold side in order to make the outflow of the fuel easy and to prevent the fuel from jetting out to make a too rich mixture in the case of spitting back. However, it is needless to say that the direction of the nozzle 16*a* can be properly changed depending on the kind of the engine. The main nozzle assembly 14** is pressed down on the top surface by a cover plate 23 secured to the carburetor body 1 through a gasket 22 so that the air-tightness between the jet holder 15 and through hole 1*a* and between the nozzle tube 16 and hole 1*b* may be secured.

Figure 3:
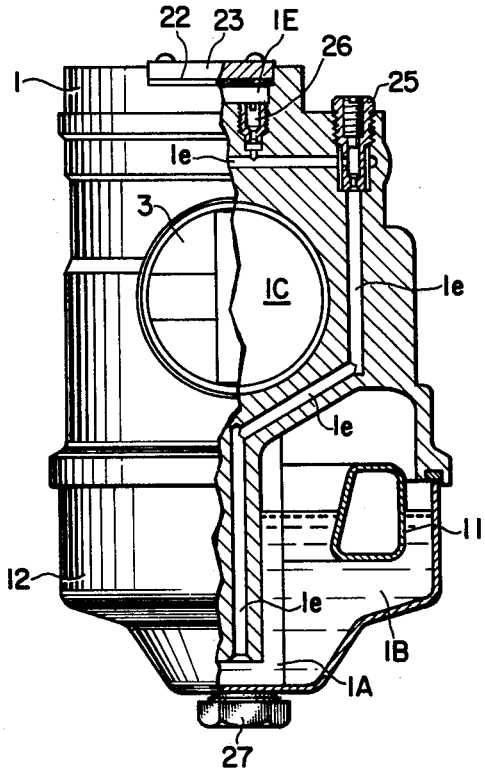
FIG. 3 is a right side view of FIG. 2 as partly sectioned.

A bottomed cylindrical jet block 24 fitted air-tightly within a hole 1*c* is provided in the upper portion of the carburetor body 1 adjacent to the air chamber 1D. A hole 24*a* communicating with a passage 1*d* the flow volume of the fuel passing through which can be adjusted by an idling screw 10 and another hole 24*b* are made in the peripheral wall of the jet block 24. Holes 24*c* communicating with the suction bore 1C are made in the bottom wall of the jet block 24. The upper opening of this jet block 24 is closed by the cover plate 23 through the gasket 22. Particularly with reference to FIG. 3, a fuel passage 1*e* opened at one end in the float chamber 1B and connected at the other end to the hole 24*b* of the jet block 24 is provided within the carburetor body 1. In the course of this fuel passage 1*e*, there are provided a pilot jet 25 screwed from above into the carburetor body 1 and a pilot air jet 26 also screwed from above into the carburetor body 1. The pilot air jet 26 communicates with a chamber 1E closed by the cover plate 23 through the gasket 22 and communicating with the air chamber 1D. Reference numeral 27 indicates a bolt screwed to the lower end of the boss portion 1A to liquid-tightly attach the cover case 12 to the carburetor body 1.

As evident from the above description, the main nozzle assembly 14 forms a main fuel system and the fuel passage 1*e*, pilot jet 25, pilot air jet 26 and jet block 24 form a low speed fuel system.

Figure 6:
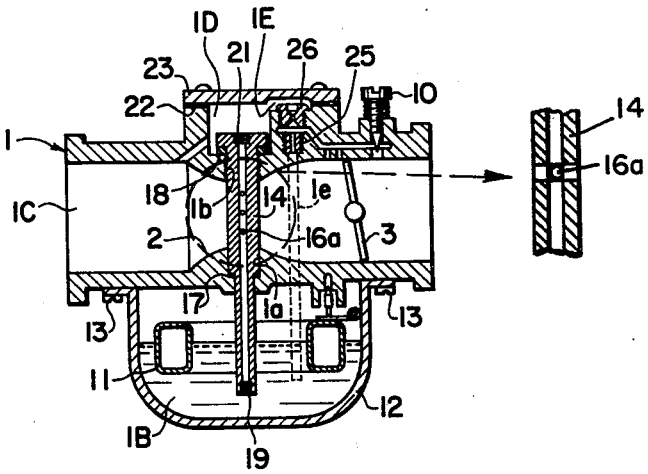
FIG. 6 is a vertical sectional view showing another carburetor embodying the present invention.

Another carburetor embodying the present invention is shown FIG. 6. In this embodiment, the main nozzle assembly 14 is further simplified. That is to say, the nozzle tube and jet holder are formed integrally with each other and the main air jet 21 and main jet 19 are screwed respectively in the upper portion and lower portion. Further, the main nozzle assembly 14 is attached to the carburetor body 1 by screwing as illustrated and no boss portion 1A is present. It is needless to say that, in this case, the bleeding pipe may be inserted into the main nozzle assembly 14 in the same manner as in the embodiment shown in FIG. 2. Further, in this embodiment, the pilot jet 25 is below the pilot air jet 26 and these are arranged concentrically with each other.

As the carburetor according to the present invention is formed as described above, when the component parts of the main nozzle assembly 14 must be replaced, the object of replacing them will be able to be attained simply by only removing the cover plate 23. In the same manner, also in the case of attaching the main nozzle assembly 14 to the carburetor body 1, the necessary work will be able to be completed by only inserting the main nozzle assembly 14 pre-assembled in advance into the holes 1*a* and 1*b* and securing the cover plate 23 to the carburetor body 1. Thus, the above mentioned work can be made very simple while the carburetor body is attached to the engine. This advantage will be developed also in the case of replacing the pilot jet 25 and pilot air jet 26. As the boss portion 1A projecting into the float chamber 1B can be made to be of a shape smaller and simpler than of the conventional one, the reduction of the effective volume of the float chamber 1B will be able to be reduced and the freedom of the selection of the structure and attaching position of the float 11 will become larger. As a result, the size of the entire float chamber will be able to be made smaller and it will be possible to make the size of the entire carburetor smaller. Further, if the cover case 12 is to be attached to the lower end of the boss portion 1A with the bolt 27 from outside as in the embodiment shown in FIG. 2, the cover case will be able to be made by pressing a plate without being cast such as being diecast and therefore the cost of the manufacture of the entire carburetor will be able to be reduced.

A proper amount of a mixture obtained from a fuel sucked in through the main jet 19 and air sucked in through the main air jet will be jetted out through the nozzle 16*a* depending on the opened degree of the throttle valve 3. However, the operation of the carburetor according to the present invention is the same as of the conventional carburetor of this kind and therefore shall not be explained in detail.

By the way, it is needless to say that, in FIG. 2, the main nozzle assembly 16 can be secured to the carburetor body 1 by being screwed into the through holes 1*a* and/or 1*b* in the same manner as in the embodiment in FIG. 6. In such case, it will be preferable to use at least a gasket instead of the O-ring 18.

What is claimed is:

1. A carburetor provided with a butterfly-shaped throttle valve, comprising a carburetor body including therein at least a suction bore having a horizontally extending venturi portion, a first hole extending vertically across said suction bore and opening in said venturi portion and a second hole arranged in parallel with said first hole; a float chamber defined below said body; a main nozzle assembly screwed in said first hole from above said body and including therein at least a main air jet, a plurality of nozzles opening in said suction bore and a main jet capable of being positioned in said float chamber; a pilot air jet screwed in said second hole; and a cover plate secured removably to said body and capable of covering the upper portion of said main nozzle assembly and pilot air jet.

2. A carburetor according to claim 1 wherein said main nozzle assembly includes therein a bleeding pipe.

3. A carburetor according to claim 1 further comprising a pilot jet capable of being screwed from outside said body vertically downward in said second hole below said air pilot jet.

4. A carburetor provided with a butterfly-shaped throttle valve, comprising a carburetor body including therein at least a suction bore having a horizontally extending venturi portion, a first hole extending vertically across said suction bore and opening in said venturi portion and a second hole arranged in parallel with said first hole and opening in said suction bore;

a float chamber defined below said body;

a nozzle tube having a lower end, an intermediate portion and an upper end portion, said nozzle tube inserted into said first hole from above said body and capable of being sealably fitted within said first hole and including therein a main jet capable of being positioned in said float chamber at the lower end, at least one nozzle opening in said suction bore in the intermediate portion, a main air jet in the upper end portion, and a bleed pipe connected to said main air jet;

said nozzle tube having a means capable of determining a correct position of inserting said nozzle tube into said first hole in cooperation with said body;

a bottom cylindrical jet block having a bottom wall inserted into said second hole, capable of being sealably fitted within said second hole and having third holes communicated with said suction bore in the bottom wall; and a cover plate secured removably to said body and capable of respectively holding said nozzle tube and jet block in respective predetermined positions within said first and second holes.

5. A carburetor according to claim 4 wherein said nozzle is directed toward the downstream side of said suction bore.

6. A carburetor according to claim 4 wherein said carburetor further comprises a pilot jet capable of being screwed from outside said body and a pilot air jet covered by said cover plate and capable of being screwed vertically downward from above said body.

7. A carburetor according to claim 4 wherein said body further includes a boss portion extending into said float chamber and including said through holes therein and a cover case for defining said float chamber is detachably secured to the lower end of said boss portion.

* * * * *